US011761211B2

(12) United States Patent
Alderman

(10) Patent No.: US 11,761,211 B2
(45) Date of Patent: Sep. 19, 2023

(54) RETROFIT ROOF WITH A PHASE CHANGE MATERIAL MODULATED CLIMATE SPACE

(71) Applicant: Robert Joe Alderman, Poteet, TX (US)

(72) Inventor: Robert Joe Alderman, Poteet, TX (US)

( * ) Notice: Subject to any disclaimer, the term of this patent is extended or adjusted under 35 U.S.C. 154(b) by 316 days.

(21) Appl. No.: 17/003,111

(22) Filed: Aug. 26, 2020

(65) Prior Publication Data

US 2021/0062510 A1 Mar. 4, 2021

Related U.S. Application Data

(60) Provisional application No. 62/922,771, filed on Aug. 27, 2019.

(51) Int. Cl.

| | |
|---|---|
| ***E04D 1/30*** | (2006.01) |
| ***E04D 1/34*** | (2006.01) |
| ***E04D 1/28*** | (2006.01) |
| ***E04B 1/76*** | (2006.01) |
| *E04B 1/74* | (2006.01) |

(52) U.S. Cl.

CPC ..... *E04D 1/30* (2013.01); *E04B 1/7612* (2013.01); *E04D 1/28* (2013.01); *E04D 1/3405* (2013.01); *E04B 2001/742* (2013.01); *E04B 2001/7691* (2013.01); *E04D 2001/304* (2013.01); *E04D 2001/308* (2013.01); *E04D 2001/309* (2013.01); *E04D 2001/3488* (2013.01)

(58) Field of Classification Search

CPC ..... E04B 1/7612; E04B 2001/742; E04B 2001/7691; E04D 1/28; E04D 1/30; E04D 1/3405; E04D 13/165; E04D 13/1681; E04D 13/17; E04D 2001/304; E04D 2001/308; E04D 2001/309; E04D 2001/3488

See application file for complete search history.

(56) References Cited

U.S. PATENT DOCUMENTS

| | | | | |
|---|---|---|---|---|
| 4,314,428 A * | 2/1982 | Bromwell | E04D 13/165 | 52/404.3 |
| 4,320,605 A * | 3/1982 | Carlson | E04D 13/1606 | 52/366 |
| 4,445,305 A * | 5/1984 | Orie, Sr. | E04G 23/02 | 52/407.3 |
| 4,494,343 A * | 1/1985 | Berry | E04D 3/3608 | 52/410 |
| 4,520,610 A * | 6/1985 | Simpson | E04B 7/00 | 52/66 |

(Continued)

FOREIGN PATENT DOCUMENTS

| | | | |
|---|---|---|---|
| CN | 103689780 A | * | 4/2014 |
| JP | 2006169885 A | * | 6/2006 |

*Primary Examiner* — James M Ference

(74) *Attorney, Agent, or Firm* — Verrill Dana, LLP

(57) ABSTRACT

A thermally modulating roof system wherein a minority of climate space between an existing and new roof is occupied by a phase change material assembly. The system maintains an industry standard of no more than a distance of about 4 inches between the roofs while still incorporating a substantial capacity to modulate an otherwise rising temperature of a facility during the day. Unique methods of installing the system, utilizing it and circulating air through the system to enhance performance are detailed.

20 Claims, 5 Drawing Sheets

(56) References Cited

U.S. PATENT DOCUMENTS 4,534,148 A * 8/1985 Simpson ..... E04C 3/08 52/645
5,005,323 A * 4/1991 Simpson ..... E04D 3/362 52/90.2
5,142,838 A * 9/1992 Simpson ..... E04D 3/3602 52/66
5,367,848 A * 11/1994 McConnohie ..... E04D 3/3608 52/336
5,626,936 A * 5/1997 Alderman ..... B32B 3/08 428/323
5,704,170 A * 1/1998 Simpson ..... E04D 3/363 52/645
5,737,894 A * 4/1998 Simpson ..... E04D 15/04 52/573.1
5,770,295 A * 6/1998 Alderman ..... E04B 9/045 428/323
5,857,292 A * 1/1999 Simpson ..... E04D 15/04 52/90.2
5,911,663 A * 6/1999 Eidson ..... E04D 13/165 52/537
6,557,313 B1 * 5/2003 Alderman ..... E04B 1/7662 52/407.3
6,645,598 B2 * 11/2003 Alderman ..... B32B 3/20 126/618
6,811,852 B2 * 11/2004 Alderman ..... F28D 20/02 428/72
6,857,238 B2 * 2/2005 Alderman ..... E04B 9/0485 52/407.3
7,174,686 B1 * 2/2007 Legband ..... E04D 3/3608 52/471
7,641,812 B2 1/2010 Alderman
7,703,254 B2 4/2010 Alderman
7,704,584 B2 4/2010 Alderman
7,987,647 B2 * 8/2011 Rymell ..... E04D 13/165 52/798.1
8,024,906 B1 * 9/2011 Nelson ..... E04D 13/165 52/410
8,061,087 B2 * 11/2011 Ray ..... E04G 23/0281 52/90.2
8,156,703 B2 * 4/2012 Alderman ..... B32B 3/08 52/407.3
8,201,375 B2 * 6/2012 Botke ..... F24S 20/67 52/554
8,327,590 B2 * 12/2012 Ray ..... E04G 23/0281 52/90.2
8,371,083 B2 * 2/2013 Chamberlin ..... E04D 13/1681 52/404.3
8,677,718 B2 * 3/2014 Marshall ..... E04D 3/3608 52/713
8,850,752 B1 * 10/2014 Graboski ..... E04D 13/17 52/95
8,938,924 B1 * 1/2015 Smith, Jr. ..... E04D 3/362 52/395
9,499,986 B2 * 11/2016 Kalkanoglu ..... E04D 13/12
10,030,392 B2 * 7/2018 Lane ..... E04D 11/005
10,179,995 B2 * 1/2019 Alderman ..... F28D 20/028
10,487,496 B2 * 11/2019 Aiderman ..... E04B 1/78
2002/0189186 A1 * 12/2002 Smith ..... E04D 13/1681 52/518
2003/0033805 A1 * 2/2003 LaViolette ..... F24S 10/25 60/641.8
2003/0061776 A1 * 4/2003 Alderman ..... F28D 20/02 52/406.1
2003/0061777 A1 * 4/2003 Alderman ..... E04B 1/76 52/406.1
2003/0129330 A1 * 7/2003 Alderman ..... B32B 27/06 156/290
2003/0167718 A1 * 9/2003 Alderman ..... E04D 13/1618 52/404.3
2003/0167719 A1 * 9/2003 Alderman ..... B32B 3/20 52/407.3
2004/0000112 A1 * 1/2004 Alderman ..... E04B 1/767 52/407.3
2004/0000113 A1 * 1/2004 Alderman ..... E04B 1/767 52/404.1
2004/0060808 A1 * 4/2004 LaViolette ..... F24S 10/25 203/1
2004/0163345 A1 * 8/2004 Alderman ..... B32B 29/02 52/406.1
2005/0055982 A1 * 3/2005 Medina ..... E04B 1/80 52/506.01
2005/0086872 A1 * 4/2005 Fligg ..... E04D 15/06 52/41
2005/0178524 A1 * 8/2005 Pause ..... F28D 20/023 165/48.1
2006/0005491 A1 * 1/2006 Cooper ..... F24S 20/67 52/302.1
2006/0117686 A1 * 6/2006 Mankell ..... E04D 13/1625 52/302.1
2007/0095388 A1 * 5/2007 Mergola ..... E04D 13/0477 136/251
2007/0207725 A1 * 9/2007 O'Hagin ..... H02S 20/23 454/365
2008/0028704 A1 * 2/2008 Cooper ..... F24S 10/73 52/302.1
2008/0312359 A1 * 12/2008 Alderman ..... C08K 3/32 524/415
2009/0011171 A1 * 1/2009 Alderman ..... E04B 1/78 428/72
2010/0275525 A1 * 11/2010 Wendelburg ..... E04D 13/1681 52/90.2
2011/0000152 A1 * 1/2011 Botke ..... E04D 13/17 52/173.3
2011/0016803 A1 * 1/2011 Ray ..... E04G 23/0281 52/302.1
2011/0120040 A1 * 5/2011 Alderman ..... E04B 2/707 165/46
2011/0173908 A1 * 7/2011 Kahle ..... E04D 5/08 52/273
2012/0079775 A1 * 4/2012 Chamberlin ..... E04D 13/165 52/698
2012/0279165 A1 * 11/2012 Marshall ..... E04D 13/1643 52/655.1
2013/0247489 A1 * 9/2013 Janesky ..... F24F 7/02 52/302.1
2014/0130425 A1 * 5/2014 Lane ..... E04D 12/004 52/90.2
2014/0366470 A1 * 12/2014 Edwards ..... E04D 1/30 52/302.1
2016/0215501 A1 * 7/2016 Dysart ..... E04D 13/178
2016/0289969 A1 * 10/2016 Shiao ..... E04D 1/30
2016/0294022 A1 * 10/2016 Thramann ..... B60L 53/63
2017/0051501 A1 * 2/2017 Whiting ..... E04B 1/3483
2017/0089083 A1 * 3/2017 Guerra ..... E04D 1/3405
2017/0237390 A1 * 8/2017 Hudson ..... E04D 3/361 136/251
2018/0073242 A1 * 3/2018 Hortom ..... E04D 3/3608
2018/0112411 A1 * 4/2018 Lane ..... E04D 11/005
2018/0278198 A1 * 9/2018 Fisher ..... H02S 20/23
2018/0355606 A1 * 12/2018 Alderman ..... E04B 1/78
2019/0106878 A1 * 4/2019 Alderman ..... E04B 1/7654
2019/0260094 A1 * 8/2019 Thramann ..... B60L 53/51
2021/0062510 A1 * 3/2021 Alderman ..... E04D 13/17

* cited by examiner

RETROFIT ROOF WITH A PHASE CHANGE MATERIAL MODULATED CLIMATE SPACE

PRIORITY CLAIM/CROSS REFERENCE TO RELATED APPLICATION(S)

This Patent Document claims priority under 35 U.S.C. § 119 to U.S. Provisional App. Ser. No. 62/922,771, filed Aug. 27, 2019, and entitled, "Phase Change Improved Retrofit Roof", which is incorporated herein by reference in its entirety.

BACKGROUND

Storage units, garages, aircraft hangars, warehouses, portions of data centers and a host of other facilities that are used more so for housing goods and equipment than for human activity are often left without any climate control capabilities. Often times, these types of facilities are simple metal buildings without any true attic or climate space available. Thus, regulating temperature within the facility may be more of a challenge as compared to a more typical home, retail, office or other space tailored to support daily human activity.

In an effort to address the temperature regulation challenges associated with these types of facilities, unique types of structurally sound insulation products have been developed over the years. For example, vinyl roller-type products with different types of insulation material incorporated therein may be utilized at the time of facility construction. So, for example, while the facility may lack a discrete attic or climate space, such insulation products may be unrolled and placed over the support beams of the facility prior to installation of the outer walls and roof. Ultimately, the facility is provided with insulated walls and an insulated roof even though the added availability of climate regulation through the use of attic space may still be lacking.

As a practical matter, there is often no need to outfit a storage unit or similar facility with any additional climate control measures beyond the cost-effective installation of uniquely tailored insulation products as described above, if that even. In many situations these facilities are meant to do no more than securely house folding chairs and tables. Thus, taking on the added expense of more complex architecture with attic space or even to provide air conditioning is simply unnecessary. Of course, this is not always the case.

In many circumstances, the goods and equipment that are to be housed may require a degree of climate control. For example, climate control storage units are often preferred for goods such as electronic storage media, film, photographs, musical instruments, medication, cosmetics, items of leather, art, antiques and other delicate articles that the owner may be concerned about being damaged by excessive temperatures. Thus, the addition of some insulation at the walls and roof may not be sufficient to protect such items. Alternative measures may be taken such as the use of wood pallets at the floor of the unit to keep goods from being in constant contact with a concrete floor. Added care may be taken to ensure weather stripping around doors is not cracked. Additionally, radiant foil-type barriers may be secured to the ceilings of the units to reflect infrared light away. Regardless, in the end, none of these measures may be sufficient to avoid the more expensive effort of making the facility truly climate controlled for proper safekeeping of these more delicate stored articles.

Additionally, these facilities are generally of steel or some other metal variation when it comes to the walls and roof.

This means that, particularly with respect to the roof, the need for repair will eventually arise, due to corrosion, weathering and other wear. While the facility may be cost-effective to build and last for decades, these repairs are unavoidable. Once more, in many jurisdictions, the cost of repair is driven up by the permitting process which often dictates the parameters of the repair process and materials required. Often the effort is directed at ensuring that the facility is more climate conscious than intended when originally constructed.

It is quite common that roof repair will involve the task of placing a new roof right over the old roof. This generally includes securing a framework of hardware at the top surface of the existing roof in order to support the new roof. For example, 3-4 inch metal beams may be secured to the old roof with a new roof then secured to the metal beams.

In some cases, the distancing of the new roof from the old roof by the framework is taken advantage of to provide an added measure of climate regulation. That is, the separation between the roofs means that a climate space or mini-attic space is now present which may be utilized. So, for example, conventional fiberglass or other insulation may be placed in the various climate spaces between the framework of hardware prior to attaching the new metal roof. Thus, in this respect, the repair to the metal roof has indeed resulted in a somewhat more climate conscious facility.

Unfortunately, as a practical matter, the climate space noted above is limited. Generally, a maximum of about 4 inches is available due to the hardware dimensions of the framework that is installed at the top of the old roof. This is because making the hardware larger would ultimately result in a less secure and stable roof addition. The new roof should indeed be in pretty close proximity to the old roof in need of repair. This means that, while some limited climate space has been provided, once conventional insulation has been placed in the climate space, the opportunity for air circulation within the space has been substantially eliminated. Ultimately, while the opportunity to take advantage of a new climate space has been presented, the overall effectiveness of this opportunity is largely limited as soon as the insulation is placed within the space.

SUMMARY

A method of retrofitting an existing roof with a new roof is disclosed. The method includes installing a framework of hardware at the top surface of the existing roof to support the new roof. The framework also serves to support a climate space between the roofs. Additionally, a phase change material assembly is also placed at the top surface of the existing roof between segments of the hardware. This assembly occupies a minority of the climate space to facilitate air circulation within the space and the method is completed by securing the new roof to the framework over the existing roof.

BRIEF DESCRIPTION OF THE DRAWINGS

Implementations of various structure and techniques will hereafter be described with reference to the accompanying drawings. It should be understood, however, that these drawings are illustrative and not meant to limit the scope of claimed embodiments.

DETAILED DESCRIPTION

Embodiments are described with reference to the use of phase change material assemblies in certain types of structural facilities. Specifically, a storage unit lacking full HVAC or air conditioning system is retrofitted with a new roof and the phase change material assemblies are uniquely positioned at certain locations on the top surface of the previously existing roof. However, a variety of different types of facilities may utilize the unique system detailed herein. Further, certain types of phase change material assemblies of particular architecture and material types are discussed. However, other types of phase change material assemblies may be utilized. Indeed, so long as the assemblies include a phase change material and are constructed to occupy a minority of the climate space between the existing and new roofs, appreciable benefit may be realized. Additionally, the overall phase change material structures are referred to by the term "assemblies" herein. They may additionally be referred to as "strips", "blankets", "sheets" or other suitable terms. Regardless, any such terms are not meant to infer any structural limitation or requirements.

Figure 1:
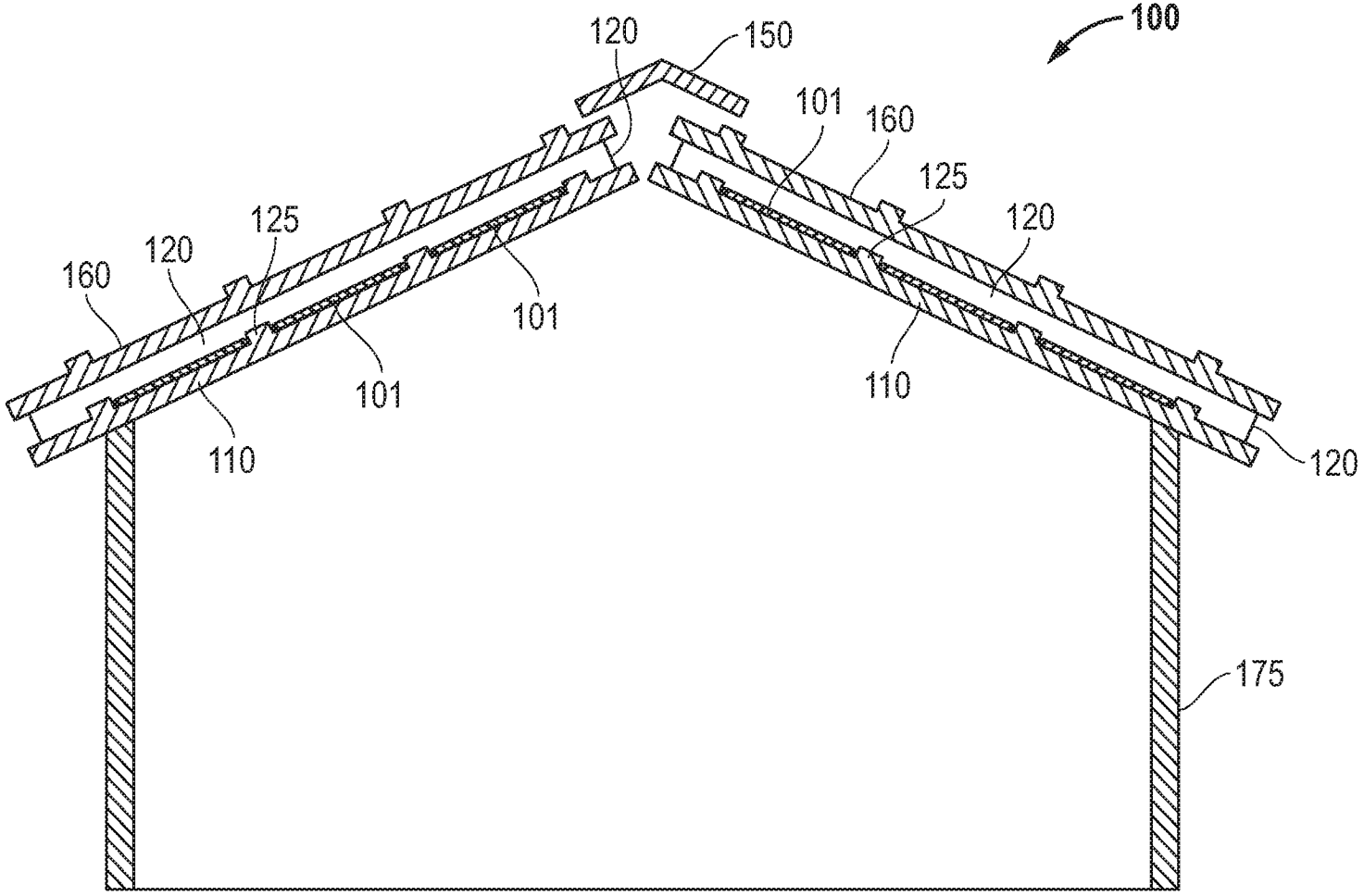
FIG. 1 is a side cross-sectional view of an embodiment of a structural facility employing phase change material assemblies installed in a climate space between two roofs.

Referring now to FIG. 1, a side cross-sectional view of an embodiment of a structural facility 100 is illustrated. With added reference to FIG. 3, the facility 100 employs a host of phase change material assemblies 101 which are uniquely positioned and installed in a climate space 300 between two roofs 110, 160. Of note, upon installation, each phase change material assembly 101 occupies a minority of this climate space 300 as detailed further below.

Figure 2A:
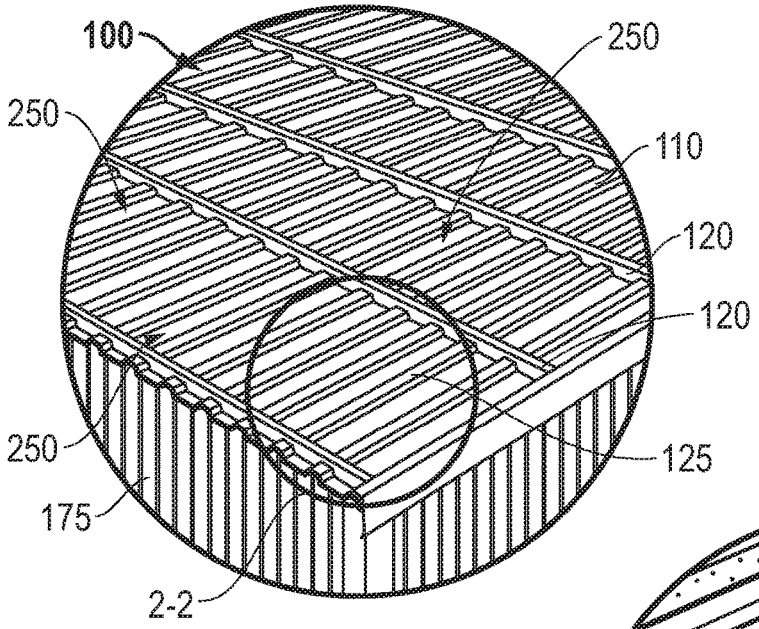
FIG. 2A is a perspective view of an existing roof to accommodate phase change material assemblies between ribs thereof.
Figure 2B:
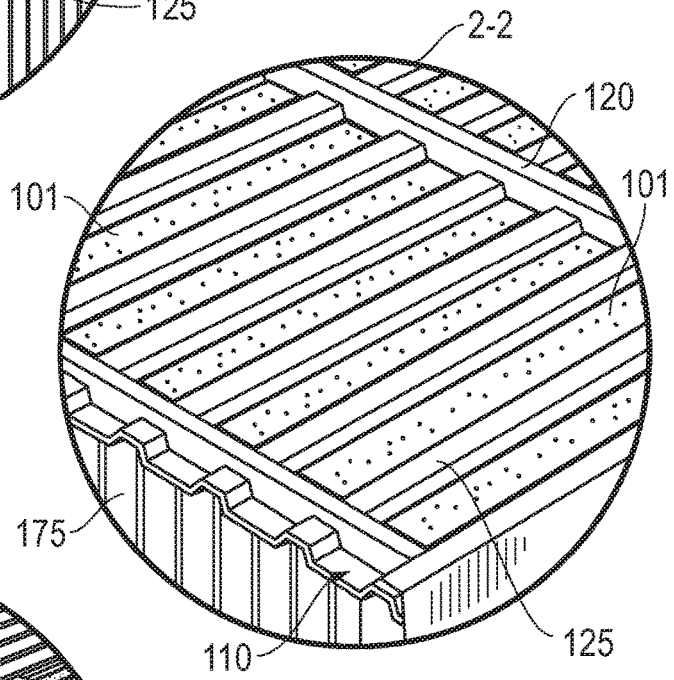
FIG. 2B is an enlarged view of the existing roof taken from 2-2 of FIG. 2A and accommodating the phase change material assemblies.
Figure 2C:
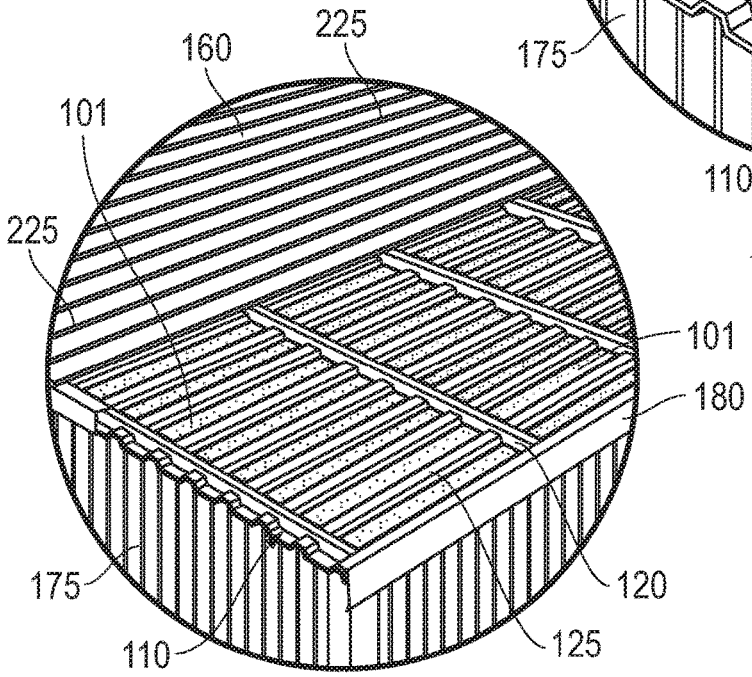
FIG. 2C is a perspective view of the existing roof of FIG. 2A with the accommodated phase change material assemblies and new roof installed thereover.
Figure 3:
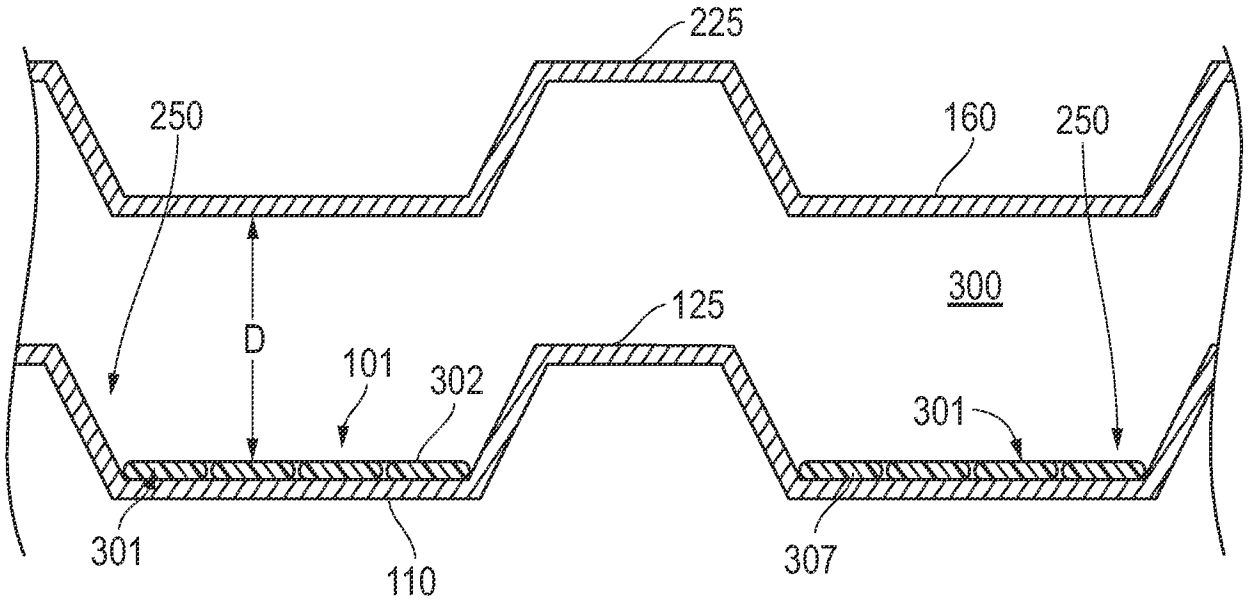
FIG. 3 is an enlarged side cross-sectional view of a portion of an embodiment of the facility of FIG. 1 illustrating phase change material assemblies occupying a minority of the climate space.

Continuing with reference to FIG. 1, the noted climate space 300 of FIG. 3 is created by the placement of hardware 120 at the existing roof 110. A new roof 160 may be installed over the existing roof 110 by securing the new roof to the hardware 120. In the embodiment illustrated, the hardware 120 is provided in the form of supportive beams. Indeed, with added reference to FIGS. 2A-2C, these beams of hardware 120 may take on an entire framework with a plurality of beams arranged across the entirety of the existing roof 110 in order to support the new roof 160.

Notice that the hardware 120 is configured to matchingly interface the existing roof 110. For example, where ribs 125 are found, the hardware 120 includes a notch or cut-out to allow for the presence of the ribs 125 and maintain substantially continuous physical interfacing with the surface of the existing roof 110. Thus, a more stable securing of the hardware 120 to the existing roof 110 may be maintained. Similarly, depending on the condition of the existing roof 110 additional supportive structure may also be positioned at the roof 110. For example, certain deteriorated ribs 125, or ribs 125 near roof corners may be retrofitted with a rib cover structure or sub-rafters in certain locations prior to securing of the noted hardware 120. Thus, a more stable accommodating of the hardware 120 and subsequent new roof 160 may be assured, particularly in more delicate locations.

In the embodiment shown, a ridge vent 150 is installed over the roofs 110, 160 to promote circulation of air generally and as detailed further below. Of course, other architectural types are possible. For example, one of the sidewalls 175 may be taller than the other with the roofs 110, 160 each taking on a linear or unitary incline form with a peak being at the interface with the taller sidewall 175 instead of at a central location as illustrated.

With added reference to FIG. 3, as noted above, the phase change material assemblies 101 are of a minimal profile so as to occupy no more than a minority of the climate space 300 between the roofs 110, 160 (see FIG. 3). In this way, sufficient airspace (D) may be present and circulation promoted as detailed further below. A challenge is presented to ensuring sufficient climate 300 or air (D) space given the nature of such new roof 160 retrofitting. Namely, for sake of security and stability, the new roof 160 will be positioned within mere inches of the existing roof 110, thus, limiting the amount of space to work with. Nevertheless, this challenge may be uniquely met with phase change material assemblies 101 as detailed herein.

Referring now to FIGS. 2A-2C, perspective views are illustrated relating to the installing of a new roof 160 over an existing roof 110 while accommodating phase change material assemblies 101 in a minority of climate space between the roofs 110, 160. Specifically, FIG. 2A illustrates an existing roof 110 slated for repair or retrofitting. In the illustration shown, a series of hardware 120 in the form of parallel beams as shown in FIG. 1 have been secured at the top of the roof 110. This results in a plurality of rectangular, somewhat isolated, valleys 250 defined by adjacent ribs 125 and adjacent hardware 120.

Referring now to FIG. 2B, an enlarged view of the existing roof 110 taken from 2-2 of FIG. 2A is shown. More specifically, each of the valleys 250 from FIG. 2A has now been filled to some extent with phase change material assemblies 101 (note the speckled appearance of each assembly 101). The phase change material assemblies 101 are of a particular architecture and include material types that are tailored to melt and/or refreeze over beneficial ranges, such as between 70° F. and 90° F. As detailed further below, the unique combination of such low profile assemblies 101 with such characteristics located in a manner allowing for airspace (D) there above, in spite of the minimal space available between roofs 110 160 may be uniquely beneficial (see also FIG. 3).

Referring now to FIG. 2C, a perspective view of the existing roof 110 of FIG. 2A is illustrated. Now, the roof 110 includes accommodated phase change material assemblies 101 at its upper surface. Further, the new roof 160, having its own ribs 225 and other features similar to the existing roof 110, is being installed and secured to the hardware 120. In the illustration shown, panels for the new roof 160 are being fully installed until reaching the edge trim 180. Ultimately, a somewhat isolated climate space 300 is found between the two roofs 110, 160 with valleys 250 accommodating phase change material assemblies 101 as illustrated in FIG. 3.

Referring more specifically now to FIG. 3, an enlarged side cross-sectional view of a portion of an embodiment of the facility 100 of FIG. 1 is illustrated. In this view, phase change material assemblies 101 are shown occupying a minority of the climate space 300. As a result, a substantial amount of airspace is left available (as illustrated by the distance (D)). This means that air circulation may be promoted between the roofs 110, 160 as detailed further below. That is, unlike conventional insulation, a phase change material assembly 101 as detailed herein may take up no more than about an inch in overall profile, likely no more than about ¼ of an inch. Therefore, even where the distance between the roofs 110, 160 is limited to about 4 inches, by the hardware 120 of FIGS. 1 and 2A-2C, the phase change material assemblies 101, still occupy a minority of that space 300. Of course, these dimensions are merely illustrative as other architectural dimensions may be involved. Regardless, so long as the phase change material assemblies 101 occupy a minority of the climate space 300, material benefit may be realized.

Continuing with reference to FIG. 3, each phase change material assembly 101 may include a core of phase change material (PCM) that displays characteristics similar to ice at between about 78°-82° F. In other words, the PCM melting point may be at about 78° F. It should be noted that, just as with water-based ice, the melting or freezing of the PCM is transitional and may occur over a given limited range of temperature, depending on factors such as purity, rate of heat transfer, etc. So, for example, as used herein, noting that the PCM has a particular freezing or melting point (e.g. 78° F.) is not meant to infer that the PCM wouldn't start to freeze at 79° F. or start to melt at 77° F., but rather that at 78° F., some transitional effects might be expected. Furthermore, while 78° F. is referenced herein as the exemplary melting point for the PCM, it should be noted that alternative material choices for the PCM may be utilized that would result in a melting point of substantially greater than or less than 78° F. The particular melting point for the selected PCM may be tailored to the environment in which the PCM assemblies 101 are to be utilized and/or the range of temperature that is desired within the facility 100 of FIG. 1.

Material choices for the PCM may be calcium chloride hexahydrate, sodium sulfate, paraffin, a fatty acid, coconut oil or a variety of other materials selected that would display a predetermined melting point such as 78° F. Such materials may be described in greater detail within U.S. Pat. Nos. 5,626,936, 5,770,295, 6,645,598, 7,641,812, 7,703,254, 7,704,584, 8,156,703, 10,179,995 and 10,487,496, each of which are incorporated by reference herein in their entireties. Regardless of the particular material selected for the PCM it may act like a solar collector, absorbing heat from the outside environment as it transitions from a "frozen" state to a liquid state as temperatures reach and exceed 78° F., in the example noted.

With specific reference to the embodiment depicted in FIG. 3, consider the circumstance of the outside environment above the assemblies 101 and roofs 110, 160 progressively getting warmer as a typical summer day progresses. The 78° F. (or cooler) frozen PCM within each assembly 101 may begin to absorb the heat of the day once this heat exceeds 78° F. and transitions to a liquid over the course of the day. However, due to this extended transition period, the heat moving from the airspace (D) above the assemblies 101 toward the interior of the facility 100 below is halted (see FIG. 1). That is, the heat is effectively unable to progress beyond the assemblies 101 until the PCM therein has melted. Along these lines, in one embodiment, the assemblies 101 may line over the ribs 125 of the existing roof 110 and not be limited to resting at the valley locations 250. So long as continuing to occupy a minority of the climate space 300 and leaving room for airspace (D) and circulation, appreciable benefit may continue to be realized as detailed further below.

Over the course of a given diurnal cycle, nightly freezing followed by daily melting of the PCM within the assemblies is readily understood. For example, in the southern U.S., an assembly 101 utilizing PCM with a melting point of 78° F. would be expected to face heat during summer days substantially in excess of 78° F. which would begin to melt the PCM. In fact, in the embodiment shown, during the day temperatures at the airspace (D) above the assemblies 101 would be expected to exceed outside temperatures. For example, with an outside temperature of 100° F., it would not be unexpected to see a 120° F. airspace temperature.

Continuing with reference to FIG. 3, note that the PCM material 307 is illustrated with hashing and found within a plurality of pods 301. Of course, a variety of different types of PCM architecture may be utilized based on different manufacturability or performance efficiencies. Along these lines, in one embodiment, the top surface of the assemblies 101 over the PCM material 307 may constitute a unique reflective layer 302. That is, in an effort to extend the time-frame of the transition so as to protect the interior of the facility 100 of FIG. 1 from heat transfer for as long as possible, a unique reflective layer 302 is provided at the outer surface of each assembly 101. The reflective layer 302 may be a conventional aluminum foil or other reflective material 302 that serves as a barrier to minimize moisture and block thermal radiation. That is, while heat may still travel through thermal conduction and convection, the presence of the reflective layer 302 substantially eliminates thermal radiation as a means of heating the PCM 307 within each assembly 101. Therefore, even in the face of adjacent extreme temperatures, the rate of melt to the PCM 307 may be minimized, thereby protecting the underlying space from heat transfer for the substantial portion of the day. Indeed, the odds of temperatures exceeding an acceptable comparable climate control high of 85° F. during any given summer day may be negligible, even in the southern U.S.

Additionally, in sharp contrast to conventional radiant barriers that utilize an adjacent airspace to avoid conduction, the reflective layer 302 of each assembly is intentionally in conductive thermal communication with the underlying PCM 307 to ensure thermal conduction therewith. There is no effort to build in any airspace into the assemblies 101 for an insulating distance from the PCM material 307. Rather, to the contrary, this upper reflective surface material 302 is in a substantially air-free conductive thermal communication with the PCM 307 below to allow for a more timely freezing of the PCM 307. For example, at night when temperature flow is in the opposite direction (e.g. heat out of the PCM 307 and into the cooler adjacent airspace (D)), the presence of a thermally conductive layer over the PCM 307 may enhance the rate of heat out and refreeze of the PCM 307.

Furthermore, along these lines, the reflective layer 302 is not only in in substantially air-free, conductive thermal communication with the PCM 307 but the material selected for the layer is itself, a thermal conductor. That is, rather than employ a conventional biaxially-oriented polyethylene terephthalate such as Mylar® or other standard metalized polymer films with minimal thermally conductive K values, materials are selected with K values greater than about 0.15. Indeed, as used herein, materials with K values below about 0.15, such as Mylar®, are referred to as thermal insulators due to the propensity to impede thermal conductivity more so than facilitate such conductivity, particularly where any degree of thickness is employed. On the other hand, materials with a K value in excess of about 0.15 are considered thermal conductors. For example, an Aluminum foil as mentioned above may display a K value in excess of 200 (e.g. at about 205). Once more, aluminum foil is readily available and workable from a manufacturing standpoint and therefore may be commonly selected, although in other embodiments, alternative thermal conductor materials (e.g. with K values above 0.15) may be employed for the reflective layer 302. Due to the particular material choices selected for the present embodiments, the reflective layer 302 serves the dual and opposite purposes of being both a reflective layer 302 during daylight hours and facilitating thermal conductivity during cooling night hours. As a result, the rate of re-freeze to the PCM 307 material at night is more than sufficient to ensure fully re-freezing of the material before the next day. Ultimately, the PCM assemblies 101 allow for the existing roof 110 to remain within a narrow range of comfortable temperature rather than allowing it to simply track the large temperature swings of the new roof 160 and/or airspace (D) temperatures.

It is worth noting that the described embodiment includes a reflective surface in direct contact with the underlying PCM. However, this layer may be separated from the PCM, for example, by another material layer, for manufacturability or other reasons. Regardless, so long as the PCM is in thermal conductivity with the reflective surface layer with no built-in airspace separation therebetween, the benefit described herein may be realized. For example, any intervening layer may have a K value of over 0.15. Once more, as detailed further below, a circulation of air out of the climate 300 and/or air (D) space may be facilitated.

Figure 4:
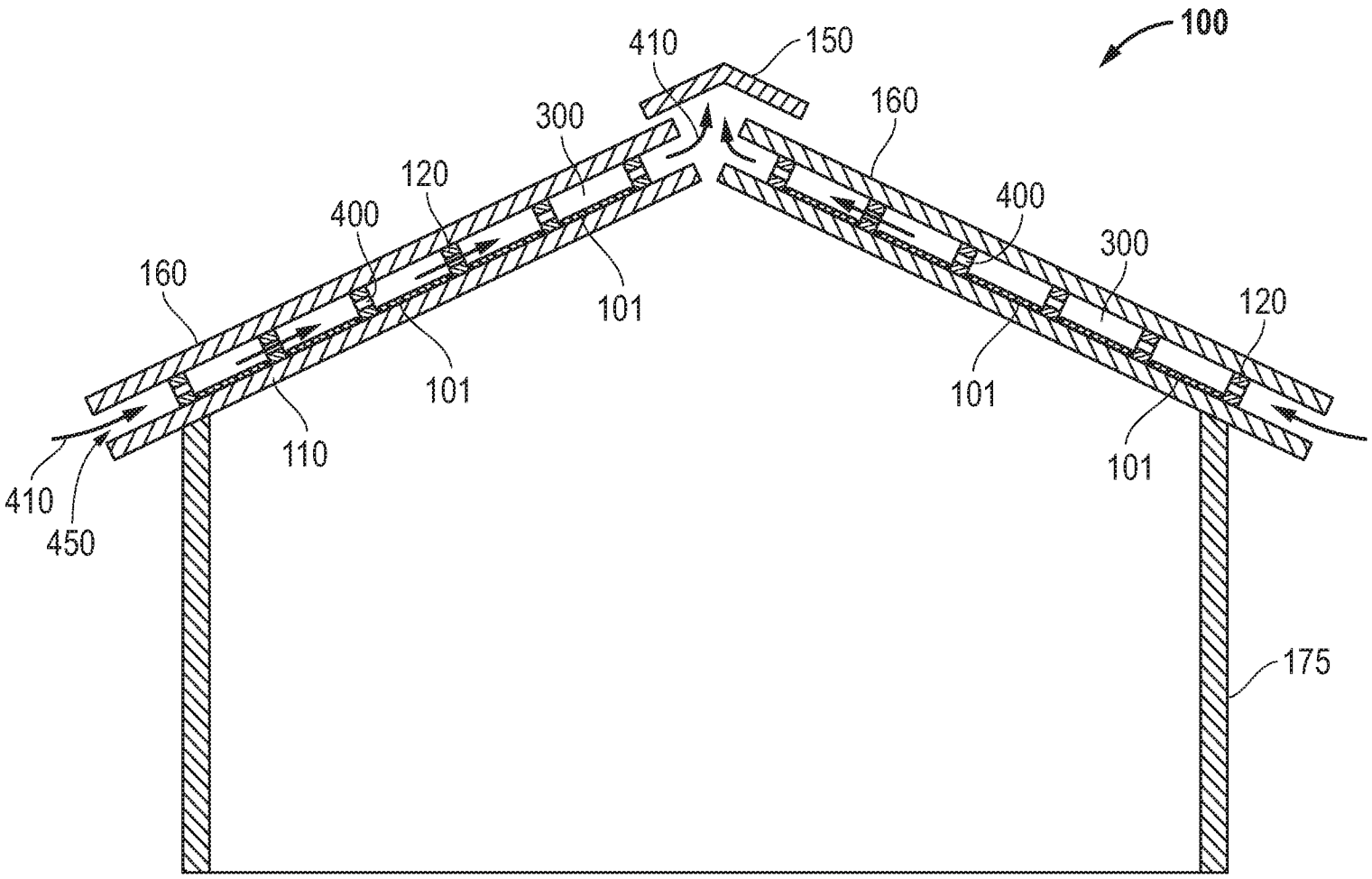
FIG. 4 is a cross-sectional view of an alternate embodiment of structural facility where hardware supporting the new roof is equipped with orifices to facilitate air flow through the facility.

Referring now to FIG. 4, a cross-sectional view of the facility 100 is illustrated in a manner highlighting air circulation that is facilitated by both the use of the PCM assemblies 101 in a minority of the climate space 300 as well as specially constructed hardware 120. That is, for the embodiment of FIG. 4, individual hardware 120 does not run from the sidewalls 475 to the peak near the illustrated ridge vent 150 as with the embodiment of FIG. 1. This may be the case due to manner in which the existing roof 110 was originally installed, perhaps with ribs that do run in a direction from sidewalls 175 to the peak. Thus, the hardware 120, generally installed perpendicular to and over ribs, might pose an impediment to circulating air 410. However, in the embodiment shown, the framework of hardware 120 throughout the climate space 300 between the roofs 110, 160 is outfitted with orifices 400. Thus, circulation is not hampered by the presence of the hardware 120 in spite of the orientation. In another embodiment, the hardware 120 may alternatively or additionally be staggered in a manner to allow for circulation similar to staggered baffling. This may be thought of akin to airflow through a plinko game board where elongated hardware 120 is found in place of pegs. Regardless, so long as the hardware 120 is either oriented as in the embodiment of FIG. 1, outfitted with orifices 400 as in FIG. 4, staggered or in some other manner allows for airflow toward a peak outlet such as the illustrated ridge vent 150, appreciable benefit may be realized.

The circulation illustrated in FIG. 4 is facilitated by, the PCM assemblies 101 in combination with other factors. For example, circulation openings 450 are provided at lower elevations than a ridge vent 150 or other outlet. Thus, as heat which has been absorbed by PCM of the assemblies 101 is encouraged to leave and rise, for example, during cooler night hours, it may travel with circulating air 410 toward the illustrated ridge vent 150 and escape the facility 100. By the same token, cooler air from outside may enter through the circulation openings 450 (e.g. from a lower and cooler entry point). Thus, not only does the presence of a thermally conductive layer at each PCM assembly 101 hasten PCM refreeze, but the layout of the entire roof system for the facility 100 is such that PCM refreeze is even further hastened. The entry of cooler circulating air 410 replacing escaping hotter circulating air 410 continues (e.g. throughout the night). Even as the entering air is heated, it is also circulated out and itself replaced.

The process continues until the disparity in the different outside and climate space 300 temperatures is negligible and the PCM of the assemblies 101 is entirely refrozen to support temperature regulation in the facility 100 for a new day. For the example noted herein, only for circumstances in which nighttime temperatures did not drop to about 78° F. for a sustained period would a complete refreeze fail to occur. Such would seem to be an impractical and highly rare occurrence.

Figure 5:
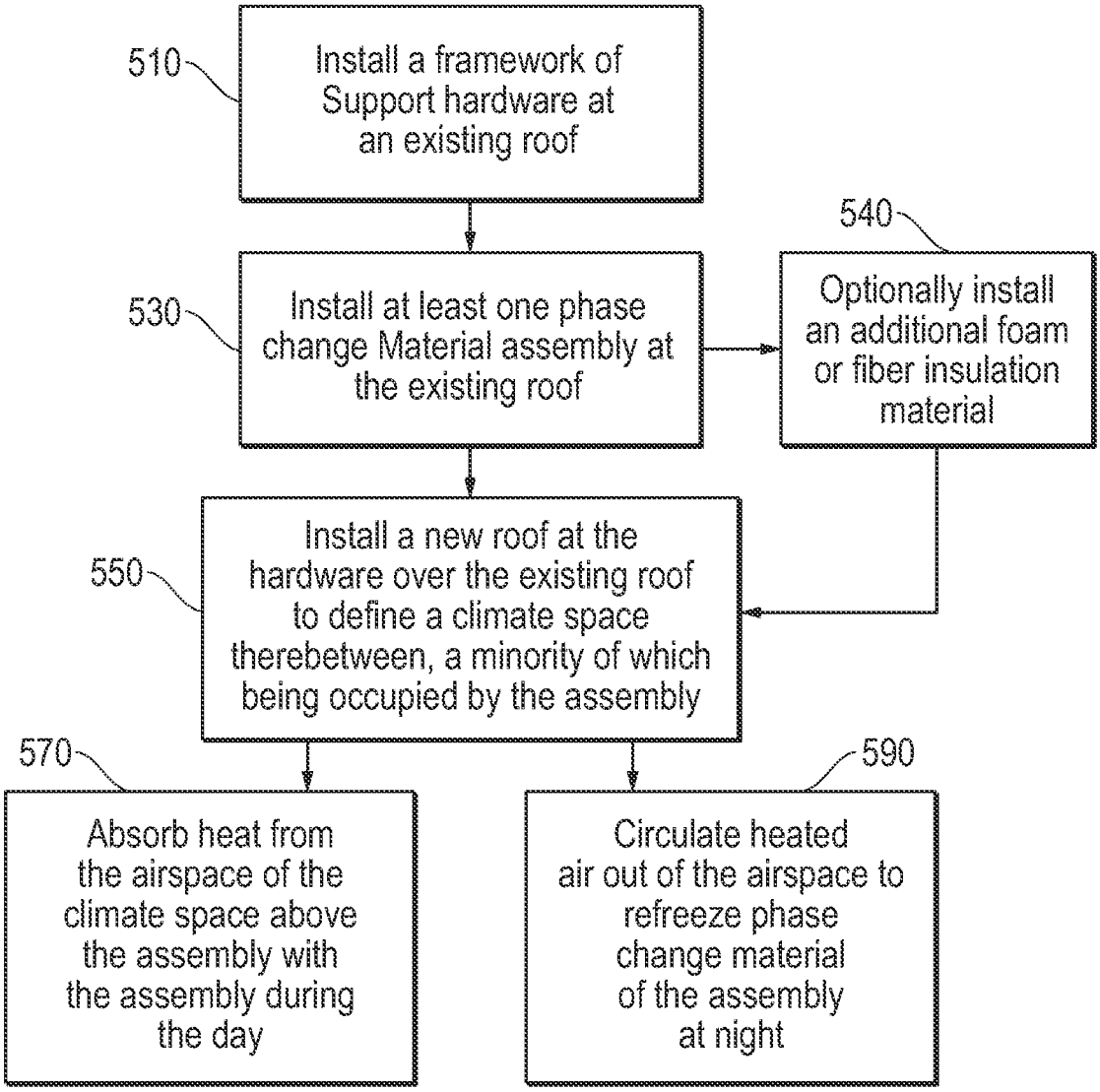
FIG. 5 is a flow-chart summarizing an embodiment of installing and utilizing a new roof with phase change material assemblies at an existing roof.

Referring now to FIG. 5, a flow-chart is illustrated summarizing an embodiment of installing and utilizing a new roof with phase change material assemblies at an existing roof. As indicated at 510, the existing roof is outfitted with a framework of hardware to support a new roof. However, as noted at 530, first, at least one phase change material assembly is also installed at the existing roof. Thus, once the new roof is attached at the hardware, a climate space is defined therein as indicated at 550. Further, only a minority of this climate space is occupied by the phase change material assembly.

The phase change material assembly may absorb heat from the airspace there-above within the climate space to modulate heat of the facility during the day (see 570). In one embodiment, much of the remainder of the climate space may be outfitted with conventional insulation or foam (see 540) as described below. However, as detailed above and indicated at 590, it may be preferable to additionally or alternatively circulate heated air out of the airspace to enhance refreeze of phase change material of the assembly during nighttime hours. The architecture of the facility, the use of thermally conductive reflective layer, the use of select phase change materials and other factors may further amplify this effect.

Embodiments described hereinabove include a unique combination of architecture, materials and techniques to address modulating temperature of a facility that generally lacks workable attic space such as a metal building with a retrofitted new roof. That is, in spite of the limited climate space between the new and existing roof, where a unique PCM assembly is installed such that only a minority of the climate space is taken up with the assembly, the opportunity is presented to dramatically modulate temperature of the facility. Even with only 4 inches or less of climate space, such an assembly may aid in the circulation out of absorbed heat therein during night hours, particularly where a thermally conductive layer is included in the assembly. Issues presented by the lack of sizable climate space to accommodate conventional insulation or other heat management tools are avoided given that the assembly may be no more than about ¼ inch in thickness. Thus, even the minimal climate space available may be taken advantage of to help modulate temperature of the facility.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while the described PCM assemblies may include a reflective material in thermal conductivity with PCM, such is not required. Indeed, a PCM assembly with or without thermally conductive reflective material may occupy a minority of the climate space which is further outfitted with conventional insulation, spray in foam or other heat modulating material. Furthermore, the foregoing description should not be read as pertaining only to the precise structures described and shown in the accompanying drawings, but rather should be read as consistent with and as support for the following claims, which are to have their fullest and fairest scope.

I claim:

1. A roof system comprising:

hardware for securing to an existing roof of a structural facility;

a new roof matchingly secured to the hardware; and at least one phase change material assembly positioned in a unitary circulating climate space between the existing roof and the new roof that is supported by the existing roof, a majority of the climate space comprising airspace, the climate space presenting an incline between a lower elevation point opening and a higher elevation point opening to facilitate circulation of air therethrough.

2. The roof system of claim 1 wherein the climate space between the existing roof and the new roofs is no more than about 4 inches in distance and a minority of the climate space occupied by the phase change material assembly is less than about one inch of the distance.

3. The roof system of claim 1 wherein the hardware includes a plurality of orifices to promote air circulation between adjacent climate spaces divided by the hardware.

4. The roof system of claim 1 wherein the existing roof comprises ribs and the at least one phase change material assembly is positioned at a location that is in a valley between the ribs.

5. The roof system of claim 1 wherein the phase change material assembly includes a reflective layer in thermally conductive communication with a phase change material.

6. The roof system of claim 5 wherein the reflective layer is a material having a thermally conductive K value of greater than about 0.15.

7. The roof system of claim 6 wherein the reflective layer is aluminum foil.

8. The roof system of claim 1 wherein the phase change material assembly comprises a phase change material with a melting point of between about 70° F. and 90° F.

9. The roof system of claim 8 wherein the phase change material includes a substance selected from the group consisting of calcium chloride hexahydrate, sodium sulfate, paraffin, a fatty acid and coconut oil.

10. A structural facility comprising:

an existing roof;

hardware secured to the existing roof;

a new roof matchingly secured to the existing roof with the hardware; and at least one phase change material assembly positioned in a unitary circulating climate space between the existing roof and the new roof, a majority of the climate space comprising airspace, the climate space presenting an incline between a lower elevation point opening and a higher elevation point opening to facilitate circulation of air therethrough.

11. The structural facility of claim 10 wherein the facility is a storage unit absent any air conditioning system.

12. The structural facility of claim 10 further comprising a vent at the higher elevation point opening to circulate the air out of the climate space that includes heat given off by freezing phase change material of the at least one phase change material assembly.

13. The structural facility of claim 12 wherein the vent is a ridge vent and the higher elevation point opening is at a peak elevation of the structural facility, the peak elevation at one of a central location of the existing or new roofs and at a sidewall of the facility.

14. A method comprising:

installing a framework of hardware at a top surface of an existing roof of a facility to support a matching new roof there above, the framework of hardware to support a unitary inclined circulating climate space between the existing and new roofs;

placing a phase change material assembly at a top surface of the existing roof between segments of the framework of hardware, a majority of the climate space comprising airspace;

securing the new roof to the framework of hardware over the existing roof; and circulating air through the unitary inclined climate space from a lower elevation point opening to a higher elevation point opening thereof.

15. The method of claim 14 further comprising introducing one of a foam and a fiber insulation material to the climate space with the phase change material assembly.

16. The method of claim 14 further comprising utilizing phase change material of the at least one phase change material assembly to absorb heat from airspace of the climate space above the assembly and modulate heat within the facility during daytime.

17. The method of claim 16 further comprising releasing the absorbed heat from the phase change material and into the airspace at night to freeze the phase change material for heat absorption the next day.

18. The method of claim 17 wherein the circulating further comprises:

circulating heated air of the airspace to an elevated vent at the higher elevation point opening and out of the facility; aid circulating air through the lower elevation point opening from outside the facility that is cooler than the heated air into the airspace.

19. The method of claim 17 further comprising enhancing a rate of release of the absorbed heat from the phase change material with a reflective layer in thermal conductivity therewith.

20. The method of claim 19 wherein the rate of release of the absorbed heat from the phase change material at night is sufficient to fully re-freeze the phase change material before the following day.

* * * * *